United States Patent [19]

Kosaka et al.

[11] 3,977,173

[45] Aug. 31, 1976

[54] TEXTURED SYNTHETIC MULTIFILAMENT YARN HAVING ALTERNATE GROUPED S AND Z TWISTS AND METHOD MANUFACTURING THEREOF

[75] Inventors: Kenzo Kosaka; Shin Morioka; Kunio Shibata; Takashi Goto, all of Nagoya; Eizi Takahashi, Toyoake, all of Japan

[73] Assignee: Mitsubishi Rayon Co., Ltd., Tokyo, Japan

[22] Filed: Mar. 26, 1975

[21] Appl. No.: 562,022

Related U.S. Application Data

[63] Continuation-in-part of Ser. No. 357,533, May 7, 1973, abandoned.

[52] U.S. Cl. ..... 57/140 J; 57/157 TS

[51] Int. Cl.[2] ..... D02G 1/02; D02G 3/34

[58] Field of Search ..... 57/140 J, 140 R, 157 TS, 57/34 AT

[56] References Cited

UNITED STATES PATENTS

| | | | |
|---|---|---|---|
| 2,999,351 | 9/1961 | Davenport et al. | 57/140 J |
| 3,058,291 | 10/1962 | Heberlein et al. | 57/157 TS X |
| 3,186,155 | 6/1965 | Breen et al. | 57/140 J |
| 3,446,005 | 5/1969 | Kosaka et al. | 57/157 TS |

*Primary Examiner*—Richard C. Queisser
*Assistant Examiner*—Charles Gorenstein
*Attorney, Agent, or Firm*—Armstrong, Nikaido & Wegner

[57] ABSTRACT

A synthetic multifilament textured yarn provided with randomly formed compact portions and bulky portions formed between two adjacent compact portions. The compact portions are provided with a certain twist and the bulky portions consist of a plurality of individual filaments, each having random crimps. Each of said individual filaments are separated from each other, and the twist direction of each of said bulky portions is opposite from that of two adjacent compact portions. This textured yarn can be produced by a conventional false-twist operation under a processing temperature between a softening point and a melting point of the material yarn.

4 Claims, 21 Drawing Figures

TEXTURED SYNTHETIC MULTIFILAMENT YARN HAVING ALTERNATE GROUPED S AND Z TWISTS AND METHOD MANUFACTURING THEREOF

REFERENCE TO PRIOR APPLICATIONS

This is a continuation-in-part application of application Ser. No. 357,533, filed May 7, 1973 now abandoned.

SUMMARY OF THE INVENTION

The present invention relates to a textured synthetic multifilament yarn having alternately grouped S and Z twists, wherein one of the grouped S and Z twist portions is formed in compact condition and another twist portion is formed in bulky configuration, and a method for producing the above-mentioned textured synthetic multifilament yarn.

In the conventional method for producing the crepe weave with thermoplastic synthetic multifilament yarn, after providing heavy first twist, the twisted yarn is subjected to a heat set operation by applying dry or wet heat so as to set the twist imparted thereon; next, the yarn is untwisted until the number of twists per unit length of yarn is turned over the zero point so that a high bulky crimped yarn having strong potential torque is produced. This high bulky crimped yarn is then treated with a sizing agent so as to temporarily eliminate the above-mentioned potential torque of the yarn. The above-mentioned sizing agent is capable of desizing in a neutral or weak basic squaring condition. The high bulky yarn treated as mentioned above, or high bulky yarn without the above-mentioned treatment with size, is utilized for weaving a cloth as the weft yarn, or a pair of high bulky yarns provided with opposite twist directions, or a pair of two different groups of high bulky yarns having opposite twist directions are alternatively picked so as to pass through sheds of the warp and then, a desizing operation is applied upon a grey fabric produced by the above-mentioned weaving operation. According to this desizing operation, the potential torque of weft is developed so that numerous fine crepes can be formed on a finished fabric. The above-mentioned grey fabric is then treated by wet process with hot liquid, and mechanical or manual vibration is applied to the fabric during the desizing operation so that the potential torque of weft yarn is effectively created and, consequently, fine crepes are formed on the fabric. Next, the crepe fabric is subjected to a conventional tenter drying operation so as to apply the heat-set treatement. If necessary, dyeing and finishing operations are further applied to the above-mentioned crepe fabric.

It is a recent tendency that the high bulky crimped multifilament yarn produced by a so-called false-twist texturing apparatus has been preferably used for producing crepe fabric, because of high productivity of the texturing apparatus, that is, high economic advantage. Such yarns are generally produced by a process employing a false-twisting texturing apparatus wherein a heated thermoplastic multifiament yarn is twisted at a yarn passage upstream from a false-twisting spindle and the twisted yarn is untwisted after passing the spindle. However, the potential torque of the false twisted textured yarn is generally not as strong as the first mentioned textured yarn produced by the twist-heat-set-untwist operation, so that the untwisting operation needs to be applied in excess to strengthen the potential torque. According to our experience, the crepe condition of the crepe fabric utilizing the false-twist textured yarn is not sharp, so that the appearance thereof is rather flat in comparison with the crepe fabric utilizing a textured yarn produced by the twist-heat-set-untwist operation. Moreover, the feeling of the false-twist textured yarn is fairly soft. Consequently, utilization of this type of crepe fabric is restricted.

On the other hand, it is understood that the crepe fabric utilizing a textured yarn produced by the twist-heat-set-untwist operation satisfies the quality requirement for many practical uses. However, it is impossible to satisfy a certain particular requirement for creation of a more distinctive crepe which is crisp to the touch.

To solve the above-mentioned particular requirement, several methods for producing a particular textured yarn have been introduced. One of them was disclosed in the Japanese Pat. No. 18072/1970, and another was presented by the Japanese Pat. No. 34976/1972. In the former method, a pair of multifilament yarns having different melting points are doubled and then this bundled yarn is subjected to a false twisting operation under a particular temperature which is predetermined within a range between the above-mentioned melting points. Consequently, the individual filaments of a multifilament yarn having a lower melting point are partially melted so that they are fused to each other. However, even if the above-mentioned purpose can be attained by utilizing this textured yarn, the crepe fabric produced is coarse and less soft to the touch. On the other hand, the above-mentioned latter method, a plurality of multifilament yarns are firstly doubled and then subjected to heat treatment so as to partially fuse the individual filaments. Next this heat-treated yarn is subjected to the false-twist operation. As the individual filaments are partially fused during the false-twist operation, creation of the potential torque on the textured yarn by the false-twist operation tends to be degraded, moreover, the textured yarn becomes coarse to the touch.

Therefore, the principal object of the present invention is to provide a textured yarn having sufficient potential torque for producing a crepe fabric having distinctive crepes.

To attain the above-mentioned purpose, extensive research has been conducted. From this research it was concluded that, if the false-twist operation is carried out in a particular condition, characterized by a processing temperature such that individual filaments of a thermoplastic multifilament twisted yarn can be collected in a compact condition of random length and at random intervals and bulky twisted groups of individual filaments can be formed between the above-mentioned collected portions, a textured yarn having sufficient potential torque for creating distinguished crepe which is soft to the touch, can be produced. Consequently, the textured multi-filament yarn according to the present invention has a particular configuration provided with alternately grouped S and Z twists wherein one of the grouped S and Z twist portions is formed in compact condition and another twist portion is formed in bulky condition.

The invention will be better understood from the following description with reference to the accompanying drawings, and its scope will be pointed out in the appended claims.

DETAILED EXPLANATION OF THE INVENTION

Principal of the Present Invention

Figure 1:
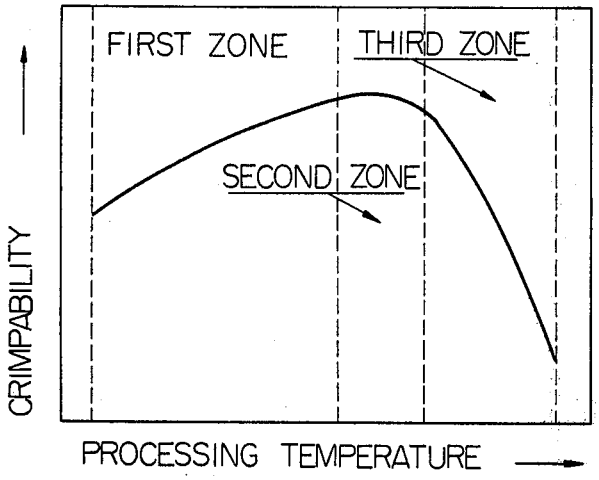
FIG. 1 is a diagram representing a relation between crimpability of a synthetic multifilament yarn and the processing temperature applied to the false-twist operation.
Figure 2:
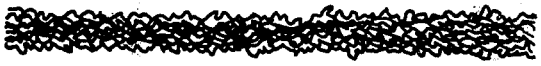
FIG. 2 is a sketch of a typical crimped synthetic multifilament yarn produced by the conventional false-twist operation.

According to our experience, the temperature at which the false-twisting operation is carried out is a very important factor effecting the crimpability of individual filaments of a supplied mulifilament yarn. Referring to the diagram shown in FIG. 1, the above-mentioned effect is hereinafter explained in detail. In this explanation the term "crimpability" represents "(length of textured multifilament yarn in straightened condition under a load which is not stronger than a tension which creates tensile elongation of individual filaments thereof)/(length of that yarn in relaxed condition)". It is well known that the crimpability of the synthetic multifilament yarn (hereinafter referred to as a yarn in this section) is enhanced by elevation of the processing temperature. This zone of processing temperature is hereinafter referred to as a first zone. However, in higher elevations of the processing temperature, the crimpability of the yarn is enhanced gradually, until it reaches its upper limit and then, the crimpability of the yarn degrades gradually. This zone of processing temperature is hereinafter referred to as a second zone. If the processing temperature is further elevated, the crimpability of the yarn degrades remarkably, and when the processing temperature rises over the melting point of the material, the false-twist operation cannot be practically carried out. The zone of this processing temperature is hereinafter referred to as a third zone. The configuration of the textured multifilament yarn changes according to the processing temperature. That is, in the first zone, each individual filament keeps its crimped configuration independently from other individual filaments as shown in FIG. 2 and, consequently, the bulkiness of the textured multifilament yarn is enhanced according to the elevation of the processing temperature. Therefore, in this condition, the potential torque of the yarn is not sufficiently strong to create a desirable crimp, even if it is soft to the touch.

Processing temperature above the optimum for creating the maximum crimpability approaches a softening temperature of the material, which corresponds to the boundary between the second and third zone, and results in degradation of crimpability, as mentioned above. In this condition, the configuration of the crimps of individual filaments becomes rough, in other words the shape of the crimp or curl or individual filaments becomes increasingly flatter. Consequently, the bulkiness of the textured yarn will be degraded, relative to the elevation of the processing temperature.

If the processing temperature rises above the softening temperature, but remains below the melting temperature of the material, the above-mentioned tendency to flatten the crimps or curl of each individual filament is enhanced. The bundle of individual filaments of the material yarn is twisted at a yarn passage upstream from the spindle under the above-mentioned heated condition, wherein the configuration of the twisted bundle of individual filaments of yarn is heat set in such a particular condition that the individual filaments are softened and are partially melted so that parts of the twisted bundle of individual filaments are strictly collected while the remaining parts of the twisted bundle of individual filaments are separatably collected as in the normal flase-twisting operation. Therefore, when the above-mentioned twisted bundle of individual filaments is untwisted by the false twisting spindle, the strictly collected portions of the yarn overcome the untwisting while the untwisting is concentrated to the separatably collected portions of the yarn. Since the number of untwists imparted to the yarn is identical to the number of twists imparted to the yarn at a position upstream from the false twisting spindle, the above-mentioned untwists imparted to the separatably collected portions of the yarn exceed the untwisting in the normal false twisting operation. This excessive untwisting is hereinafter referred to as "overtwisting". As mentiond above, the separatably collected portions of the bundle of filaments is provided with distinguished crimps or curls together with torque so that bulky portions of the textured yarn are created between two adjacent strictly collected portions.

Figure 3:
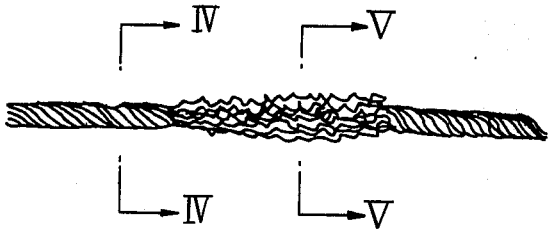
FIG. 3 is a sketch of a textured synthetic multi-filament yarn according to the present invention.
Figure 4:
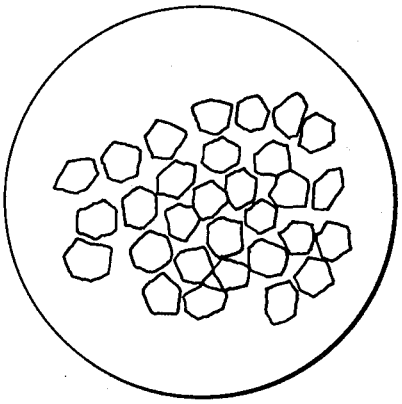
FIG. 4 is a cross-sectional view of the textured yarn, taken along a line IV—IV in FIG. 3.
Figure 5:
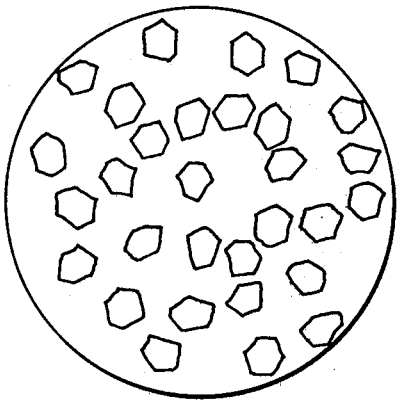
FIG. 5 is a cross-sectional view of the textured yarn taken along a line V—V in FIG. 3.
Figure 7A:
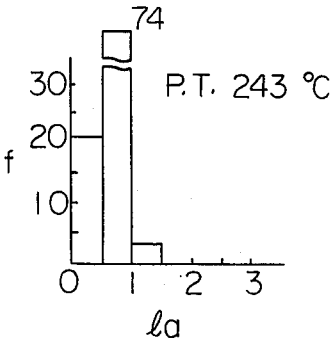
FIGS. 7A, 7B, 7C, 7D, 7E and 7F are histograms showing distribution of frequency in connection with the length of partly compact portions or that of partly bulky portions of the textured yarns produced by the method according to the present invention, at different processing temperatures.
Figure 7B:
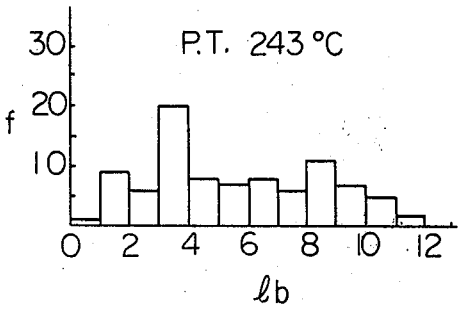
Figure 6:
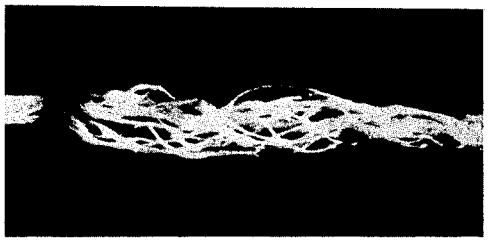
FIG. 6 is a microscopic photograph of textured synthetic multifilament yarn which is an embodiment of the present invention.

According to our experimental tests, it was confirmed that the above-mentioned strictly collected portions of individual filaments are distributed at random along the lengthwise direction of yarn, and the length of each collected bulky portion of the textured yarn, according to the present invention, varies according to the processing conditions. To effectively produce the above-mentioned characteristic configuration of the textured yarn, it is preferable to feed a multifilament yarn to a false-twisting head in an over-feeding condition, while the treated yarn is delivered in an over-feeding condition from the false-twisting head and taken-up by a takeup device. The characteristic configuration of the textured yarn according to the present invention is shown in FIG. 3 and the transverse sections of the collected portions and bulky portions thereof are shown in FIGS. 4 and 5, respectively. That is, in the twisted bundle portions, the individual filaments are tightly collected as shown in FIG. 4. These twisted bundle portions are hereinafter referred to as compact portions. Numerous bulky portions are created between two adjacent compact portions. In these bulky portions, the individual fibers are positioned in loose condition as shown in FIG. 5. It is important to note that, according to the false-twist operation, under a processing temperature within the third zone, a textured yarn having a particular configuration characterized by a plurality of compact portions randomly distributed along the yarn and a plurality of bulky portions composed of crimped individual filaments distributed between two adjacent collected portions can be produced. According to our repeated mill tests, it was confirmed that, in most portions of this textured yarn, S or Z twist is imparted alternatively to the compact portions, while the bulky portions are provided with twists in a direction opposite the two adjacent compact portions. It was also confirmed that the twist direction of the compact portions is identical to the direction of the false twisting operation, and in a pair of compact portions and a bulky portion of yarn formed between these compact portions, the direction of the bulky portion is opposite that of the compact portions. The total number of twists of the compact portions substantially equals the total number of twists imparted to the bulky crimped portion. As the directions of these two kinds of twists are opposite to each other, the number of twists of the bulky crimped portions becomes distinguished, Therefore, textured yarn with potential torque somewhat stronger than the torque or normal textured yarn produced under a processing temperature in the first zone, can be produced.

When the processing temperature exceeds the upper limit of the third zone, that is the melting point of the material, the individual filaments are partly fused to each other, and the false-twist operation becomes practically impossible to carry out under this condition.

To illustrate the change in configuration of the textured yarn according to the present invention, the tension of the multifilament yarn was subjected to the false-twist operation, and the processing temperature was changed. It was our conclusion that, if the material yarn is supplied to the false-twist zone under the condition of over-feeding, the frequency of creating the compact portion tends to increase in relation to the increased rate of over-feeding.

The length and frequency of each compact portion of the individual filaments vary according to processing conditions such as processing temperature, number of twist imparted to the yarn, processing tension applied to the material and driving speed of the false-twist spindle. However, in our repeated experimental tests it was observed that, if the processing temperature is elevated towards the melting point of the material which corresponds to an upper limit of the third zone, the length of the compact portions increase and that of bulky portions tend to gradually shorten and the frequency of these compact portions tends to increase.

Table 1 and histograms shown in FIGS. 7A, 7B, 7C, 7D, 7E and 7F, present the above-mentioned information. These data were obtained from the following experimental tests. A polyethyleneterephthalate multifilament yarn of 75 d/24 f was subjected to a false-twist operation by a conventional false-twisting machine (type CS-9 manufactured by E. Scragg Co., British Corporation) under the following condition.

| | | |
|---|---|---|
| (a) | Spindle r.p.m. | 300,000 |
| (b) | False twist | |
| | (test group A) | 3390 Z twist |
| | (test group B) | 4200 Z twist |
| (c) | Percentage of over-feed in yarn supply into the false-twist zone | 2% |
| (d) | Percentage of over feed to yarn winding | 5% |
| (e) | Processing temperature | |
| | test group A | 215°C, 237°C and 240°C |
| | test group B | 243°C, 246°C and 249°C |

Test pieces are taken from textured yarn packages and the partly compact portions and bulky portions are observed along the lengthwise direction of each test piece by utilizing a microscope of low magnification. The length of compact portions and bulky portions are successively measured. In the above-mentioned experimental test, 10 test pieces were randomly sampled, and ten measurements were carried out for each test piece. In the histograms shown in FIGS. 7A to 7F, the abscissa represents the length ($l_a$ in mm) of the partly compact portions or the length ($l_b$ in mm) of the partly bulky portions, while the ordinate represents the frequency (f), and P.T. represents the processing temperature in °C. In Table 1, below, the data in columns 2 and 3 represents the arithmetic mean of the observed length of the partly compact portions ($\bar{l}_a$)and that of the partly bulky portions ($\bar{l}_b$), respectively.

Table 1

| Processing temperature in °C | Compact $\bar{l}_a$ in mm | Bulky $\bar{l}_b$ in mm | False-twist T/meter |
|---|---|---|---|
| 215 | impossible to count | impossible to count | 3390 Z |
| 237 | " | " | 3390 Z |
| 240 | " | " | 3390 Z |
| 243 | 0.62 | 5.59 | 4200 Z |
| 246 | 0.60 | 4.11 | 4200 Z |
| 249 | 0.49 | 2.14 | 4200 Z |

To confirm the influence of the number of false-twist imparted to the material yarn upon the configuration of the textured yarn according to the present invention, the following experimental test was carried out. That is, the same material yarn and same texturing apparatus as the above-mentioned test for confirming the influence of processing temperature were utilized. In this experimental test, the false-twist spindle was driven at 300,000 r.p.m. and the same percentage of over feeding yarn as the above-mentioned test was applied. In this experimental test, the same processing condition as the condition of Example 1 which is hereinafter illustrated was applied, except for the number of false-twists imparted to the material yarn and processing temperatures.

Table 2

| Identification No. | Number of false-twist T/meter | Processing temperature in °C | Condition of texturing operation (note 1) | Measured torque of textured yarn in cm.mg (note 2) | |
|---|---|---|---|---|---|
| 1 | 3500 | 220 | ○ | 10.5 | Coventional yarn |
| 2 | 4000 | 210 | ○ | | Experiment |
| 3 | 4000 | 220 | ○ | | |
| 4 | 4100 | 210 | Δ | | Experiment |
| 5 | 4100 | 220 | Δ | | |
| 6 | 4200 | 210 | X | | |
| 7 | 4200 | 220 | X | | |
| 8 | 4200 | 230 | ○ | | Experiment |
| 9 | 4200 | 240 | ○ | 16.5 | |
| 10 | 4200 | 250 | ○ | 17.0 | |
| 11 | 4200 | 253 | X | | |
| 12 | 4400 | 230 | Δ | | |
| 13 | 4400 | 240 | ○ | | Experiment |
| 14 | 4400 | 250 | ○ | | |
| 15 | 4400 | 253 | X | | |
| 16 | 4600 | 230 | X | | |
| 17 | 4600 | 240 | Δ | | |
| 18 | 4600 | 250 | ○ | | |
| 19 | 4600 | 253 | X | | |
| 20 | 4800 | 230 | X | | Experiment |
| 21 | 4800 | 240 | X | | |
| 22 | 4800 | 253 | X | | |
| 23 | 5000 | 250 | Δ | | |
| 24 | 5000 | 253 | X | | |
| 25 | 5200 | 250 | X | | |

Note 1:
In the column "Condition of texturing operation": the symbol ○ represents a condition wherein the texturing operation is carried out without yarn breaks, in stable condition;
the symbol Δ represents a condition wherein the texturing operation is carried out with some yarn breaks, but can be carried out;
the symbol X represents a condition wherein the texturing operation can not be carried out because of frequent yarn breaks or melting of the processing material.
Note 2:
The torque is measured by the instrument shown in FIGS. 9 and 10.

Figure 8:
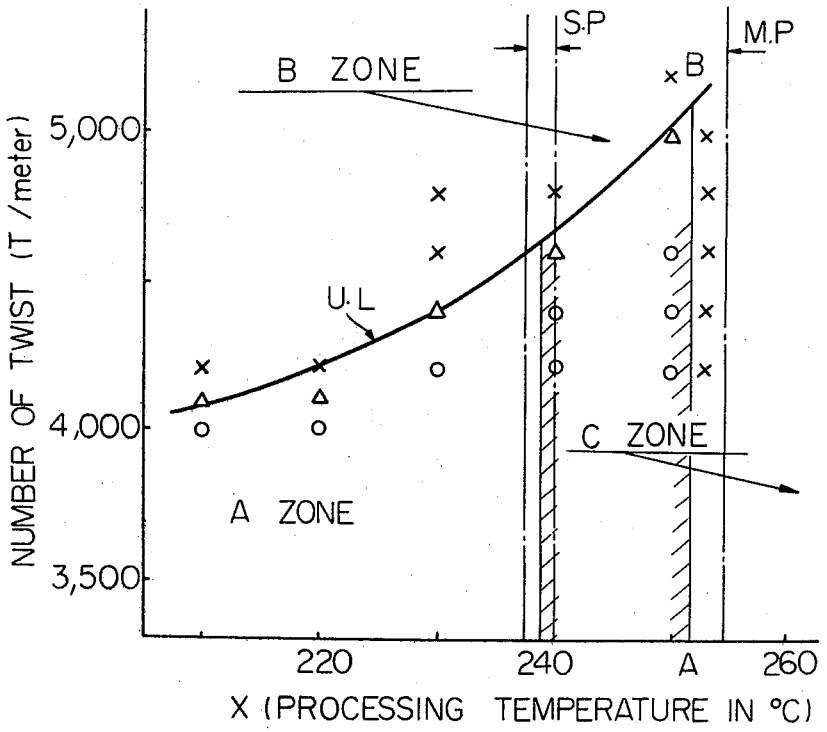
FIG. 8 is a diagram showing the results of the process under different conditions of processing temperature in connection with the different number of false twists applied to the processing.

The diagram shown in FIG. 8 represents the general relationship between the number of twist of the false twisting operation and the processing temperature. As it can be understood from this drawing, there is a border line represented by a line U.L. It may be understood that, the texturing operation can be carried out in the conditions of a zone defined by the line U.L., X axis and Y axis and a line $\overline{AB}$, which represents a processing temperature a little below the melting point of the material yarn. Consequently, the textured yarn according to the present invention can be produced only in the condition defined by the line U.L. in the second zone.

Further, it was confirmed that if the processing temperature and the rate of over-feeding are selected in pertinent conditions, a textured yarn having randomly distributed compact portions of various lengths and a plurality of bulky portions formed between the two adjacent compact portions, can be produced. This textured yarn has sufficient potential torque to create unique and sharp crepes in a crepe fabric. Consequently, in practical mill operation, it is necessary to choose processing conditions with the above-mentioned mentioned basic knowledge. Therefore, if the end use of the textured yarn is to produce a crepe fabric, the processing condition can be decided upon by measuring the potential torque of the yarn.

To confirm the ability to create distinguished potential torque which is required for manufacturing the crepe fabric, the textured yarns produced by the conventional false-twist operation under a particular processing temperature within the range of the third zone were subjected to a tentative test, for estimating the potential torque thereof, which will be explained hereinafter.

Figure 9:
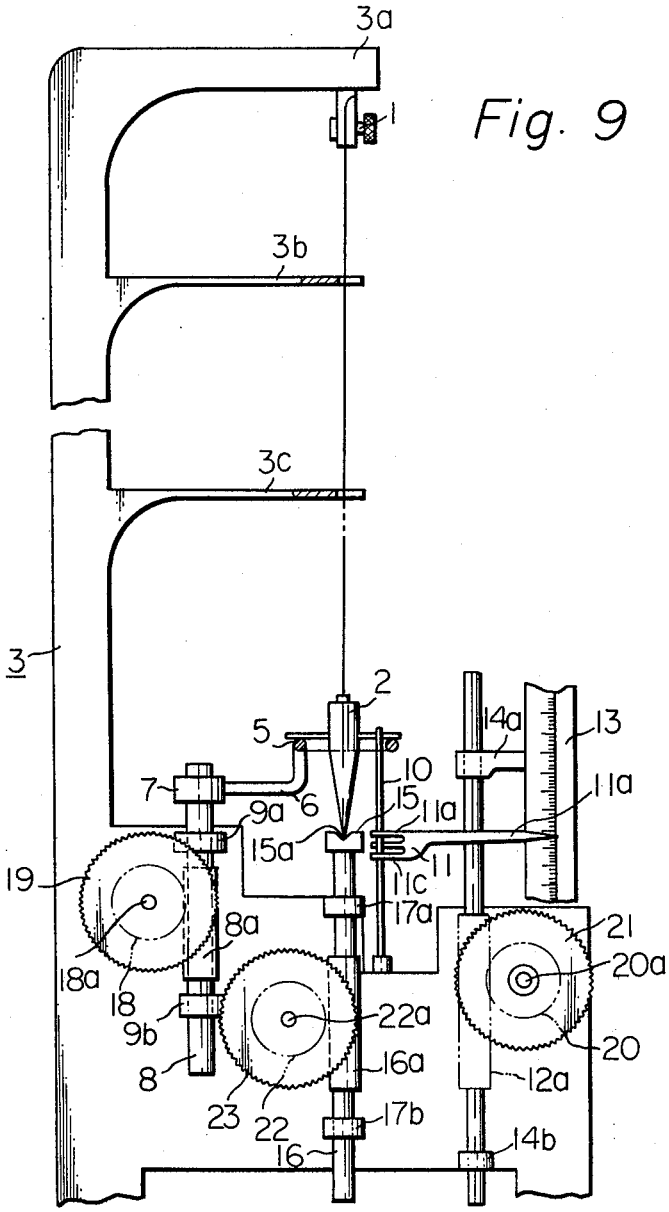
FIG. 9 is a side view of a tentative instrument to measure the potential torque of the textured yarn according to the present invention.
Figure 10:
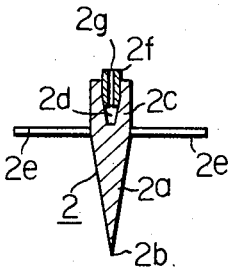
FIG. 10 is a cross-sectional view of a lower grip piece used for the instrument shown in FIG. 9.

Referring to FIGS. 9 and 10, the instrument for measuring the potential torque of the yarn comprises an upper grip 1 supported by a top flange 3*a* of a frame 3 of the instrument and a pair of yarn guides 3*b*, 3*c* horizontally projecting from the frame 3 to guide a test piece (textured yarn) 4 hung from the upper grip 1, a horizontal support 5 having a shape of a two-legged fork which is rigidly connected to a horizontal connecting rod 6 provided with a cap 7 being turnably supported by a vertical shaft 8, an elastic thin rod 10 rigidly mounted on the frame 3 in vertical condition; a movable support 11 comprising three horizontal guide pieces 11*a*, 11*b* and 11*c*, which is slidably engaged with the thin rod 10 and a support 15 is provided with a downwardly concaved recess 15*a*. The support 15 is rigidly mounted on top of a vertical rod 16. A vertical scale 13 is rigidly mounted to the frame 3. The vertical rod 8 is slidably supported by a pair of guides 9*a*, 9*b* secured to the frame 3 and is provided with a worm portion 8*a* which engages with a worm wheel 18 mounted on a shaft 18*a* turnably supported by a bearing (not shown) secured to frame 3. A hand wheel 19 is secured to the shaft 18*a*. Consequently, the vertical rod 8 is capable of being displaced upward and downward by turning the hand wheel 19. The vertical rod 16 is slidably supported by a pair of guides 17*a*, 17*b* secured to the frame 3 and is provided with a worm portion 16*a* which engages with a worm wheel 22 rigidly mounted on a shaft 22*a* turnably supported by a bearing (not shown) secured to the frame 3. A hand wheel 23 is rigidly mounted on the shaft 22*a*. Consequently, the vertical rod 16 is capable of being displaced upward or downward by turning the hand wheel 23. The vertical rod 12 can be displaced upward or downward in a way similar to the vertical rod 16. That is, the vertical rod 12 is slidably supported by a pair of guides 14*a*, 14*b* secured to the frame 3 and is provided with a worm portion 12*a* which engages with a worm wheel 20 rigidly mounted on a shaft 20*a* turnably supported by a bearing (not shown) secured to the frame 3. A hand wheel 21 is rigidly mounted on the shaft 20*a* so that the above-mentioned motion of the vertical shaft 12 is carried out by turning the hand wheel 21. In the above-mentioned instrument, the movable support 11 is horizontally secured to the vertical shaft 12 as shown in the drawing, and an indication wire 13 is horizontally extended toward the scale 13. A lower grip piece 2, which grips a lower end of a test piece 4, is provided with a conical sharpened portion 2*a* and a hollow portion 2*c* provided with a downwardly concaved hollow 2*d* and a pair of horizontal pins 2*e* secured to the hollow portion 2*c* in symmetrical condition about the longitudinal axis of the grip piece 2. The lowermost point of the sharpened portion 2*a* is represented by 2*b*. A small piece 2*f* is provided with a yarn guide conduit 2*g* passing therethrough along the longitudinal axis thereof and is provided with a conical outer surface so as to put the piece 2*f* into the concaved hollow 2*d* of the lower grip piece 2. The relative position of the horizontal support 5 to the horizontal pins 2*e* of the lower grip piece 2 is arranged so that the horizontal support 5 is capable of locating at a first predetermined position where the lower grip piece 2 is supported by the horizontal support 5 above the support 15 before commencing the potential torque measurement, and is capable of locating at a second predetermined position where the point 2*b* of the lower grip piece 2 rests on the center point of the recess 15*a* of the support 15, and is capable of locating at a third predetermined position below the second position. The relative position of the top end of the elastic thin rod 10 is slightly above the horizontal pins 2*e* of the lower grip piece 2 which is supported by the horizontal support 5 located at the second position thereof.

The torque measurement is carried out as follows. An end of a test piece is firstly inserted into the conduit 2*g* of the small piece 2*f* and inserted into the hollow 2*d* of the lower grip piece 2. The horizontal support 5 is positioned at the first position and the lower grip piece 2 rests on the horizontal support 5. Next, the horizontal support 5 is displaced to the second position by turning the hand wheel 19. Next another end of the test piece 4 is provisionally gripped by the upper grip 1. During this operation, the test piece 4 is inserted into the yarn guides 3*b*, 3*c* by passing it through slits (not shown) in these yarn guides 3*b*, 3*c*. During this operation, it is important to straighten the test piece 4 by the weight of the lower grip piece 2. Then, the end of the test piece 4 is stably gripped by the upper grip 1. The movable support 11 is positioned slightly below the support 5 by turning the hand wheel 21. Next the support 5 is displaced to its third position by turning the hand wheel 19. In this condition, if the piece 2 does not stand vertically, then the hand wheel 23 is turned so as to displace the support downwardly and stand the piece 2 vertically. As the movable support 11 is positioned at its upper-most position, the turning motion of the piece 2 around an axis which coincides to a longitudinal axis of the test piece 4 can be prevented. Now, the position of the upper end of the elastic thin rod 10 corresponds to a zero point of the scale 13.

After completion of the above-mentioned preparation, the hand wheel 21 is turned so as to displace the movable support 11 downward. As a torque F (see FIGS. 9 and 11B) is imparted to the top end portion of the elastic thin rod 10, bending of the elastic thin rod 10 is increased according to amount of free length of the rod which is above the upper contact point of the movable support therewith. And finally, the horizontal pin 2*e* passes over the top end of the elastic thin rod 10. Then the position of the upper contact position of the movable support with the rod 10, which corresponds to a lower end of the free length of the rod 10, is measured by the indication pin 11*a* on the scale 13. The above-mentioned free length of the rod 10 is hereinafter referred to as "bending length".

Consequently, the potential torque of the test piece 4 can be indirectly measured by measuring the above-mentioned bending length.

To calculate the potential torque from the bending length of the elastic thin rod 10, the following additional test was applied.

Figure 11A:
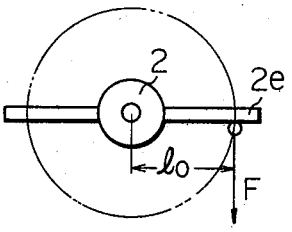
FIGS. 11A, 11B and 11C are schematic views illustrating the principle of measuring the torque of yarn.
Figure 11B:
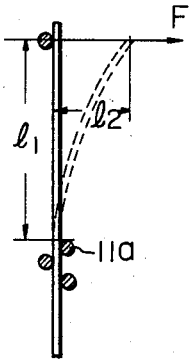

As the initial contact point of the horizontal pin 2*e* with the elastic thin rod 10 is predetermined, the distance between the longitudinal central axis of the lower grip piece 2 and the above-mentioned contact point is represented as $l_o$ (see FIG. 11A), the bending length of the elastic thin rod 10 is represented as $l_1$ (see FIG. 11B). The position of the top end of the elastic rod 10 must be a constant point because the horizontal pin 2*e* has to pass over the top end of the elastic rod 10 when the lower grip piece 2 commences to turn about its longitudinal axis according to the potential torque of the test piece 4. Consequently, the displacement of the top end of the rod 10 in the horizontal direction is represented by $l_2$ which is constant.

Figure 11C:
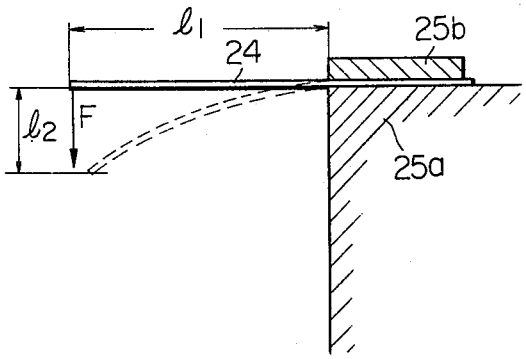

Under the above-mentioned background, forces which are required to deform the elastic thin rod 10 up to the length $l_2$, were measured in different conditions of $l_1$ by applying a bending force measuring method shown in FIG. 11C. In this measurement, a test piece 24 of the same material as the elastic rod 10 is gripped by a pair of grips 25*a*, 25*b*, so as to grip the test piece 24 in a horizontal condition. A force F, which was imparted to a free end of the test piece 24, was measured by utilizing a conventional torsion balance. In this test, the downward displacement of the free end of the test piece 24 is fixed at constant $l_2$, while the length ($l_1$) of the test piece 24 is varied.

Figure 12:
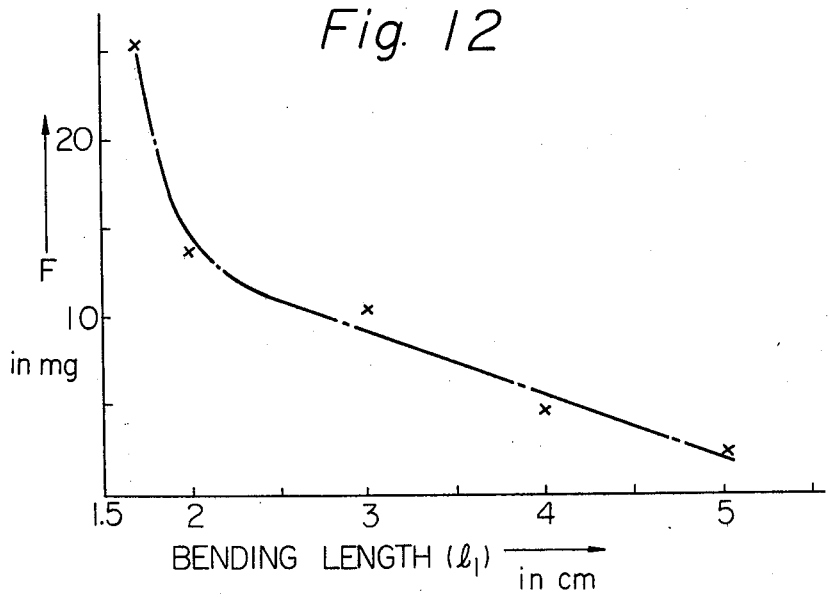
FIG. 12 is a diagram illustrating a relation between "bending force " and "external force for deforming an elastic material"

The diagram shown in FIG. 12, which represents a relationship between the bending length ($l_1$) and the force F which is required to displace the free end of the test piece 24 by $l_2$, was made by utilizing Nylon monofilament for fishing (100 denier). This monofilament was used as the elastic thin rod 10 for our test. Consequently, the force F corresponding to any bending length $l_1$ can be calculated according to the diagram shown in FIG. 12. That is, when the bending length $l_1$ is measured by the above-mentioned test by utilizing the instrument shown in FIG. 9, then the corresponding force F is obtained from the diagram shown in FIG. 12. In the above-mentioned test the distance $l_2$ was set as 15 mm. With this distance for $l_2$ the potential torque T is calculated by the following equation.

$$T = F \times l_2 = 1.5F \text{ cm·mg}$$

(Note: Generally, the above-mentioned potential torque is represented to as "torsional moment".)

According to the experimental mill tests, if the potential torque of the textured yarn is too strong, the warping operation of knitting operation is practically difficult, because of the frequent development of snarls during the operation. To solve this problem, extensive and repeated research was conducted and it was concluded that the excess potential torque can be satisfactorily weakened by applying a certain additional twist upon the above-mentioned textured yarn so as to impart twist of identical direction to the false-twist. Several examples will be hereinafter illustrated to explain the above-mentioned solution.

During weaving utiizing the above-mentioned textured yarn, it was found that the crepe fabric utilizing the textured yarn according to the present invention has pertinent softness to the touch even if distinctive crepes are produced.

According to our further experimental tests, if an additional twist is imparted to the above-mentioned textured yarn of the invention, so as to untwist the compact portions of the yarn, very effective potential torque can be created in the compact portions having different twist direction from the twist direction of the additional twist. The portions having the above-mentioned newly created potential torque are distributed randomly along the yarn, because the twist direction of the compact portions of the textured yarn produced by the false-twist operation randomly changes in S-twist or Z-twist direction. Consequently, very unique crepes can be created on a crepe utilizing this type of textured yarn. An example of applying this type of textured yarn is hereinafter illustrated in Example 2(b).

EXAMPLE 1

A polyethyleneterephthalate multifilament yarn of 75 d/24 f was subjected to a false-twist operation by a conventional false-twisting machine (type CS-9, manufactured by E. Scragg Co., British Corporation) under the following conditions.

| | | |
|---|---|---|
| (a) | Spindle r.p.m. | 300,000 |
| (b) | False-twist | 4200 t/meter S direction or Z direction |
| (c) | Processing temperature | 240°C |
| (d) | Percentage of over feed in yarn supply into the false-twist zone | 2% |
| (e) | Percentage of over feed to yarn winding | 4% |

The configuration of these textured yarns are represented in FIG. 3. (Note: The difference between the above-mentioned two yarns is only due to the difference of the direction of this false-twist operation. Consequently, in the following operation, the term "the textured yarn" represents either one of these two yarns.)

The potential torque of the textured yarn produced by the above-mentioned false-twist operation is tested by the above-mentioned method for measurement of the potential torque. According to this torque measurement, the potential torque T of the textured yarn produced under the conventional condition was 10.5 cm·mg. The potential torque of a textured yarn produced by applying the processing temperature at 220°C in a condition of false-twist 3500 T/meter, which is in the above-mentioned second zone, was also subjected to the test for comparison. The potential torque of this yarn was 16.5 cm·mg. Consequently, it was confirmed that the potential torque of the textured yarn of this example is very strong.

Figure 13A:
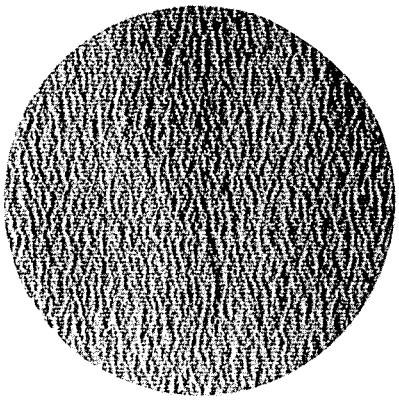
FIG. 13A is a photograph showing the distinguished development of crepes upon a crepe fabric according to the present invention.

To confirm the utility of this textured yarn, the following test was carried out. That is, a fabric having a plain weave was produced under the following conditions.

a. Warp yarn:
   i. Polyethyleneterephthalate multifilament yarn of 50 d/36 f provided with an additional S twist of 250 t/m.
   ii. Density of reed 95/38 cm 2 warp yarn/reed.
b. Weft yarn:
   i. Double picks with the above-mentioned textured yarn.
   ii. Direction of twist of the weft yarn was alternatively changed to S or Z false-twist at each double-pick.
   iii. Density: 125 picks/3.8 cm
c. Width of grey fabric: 112.5 cm Next, the grey fabric was wet treated in a hot water. In this wet processing, mechanical vibration was applied to the grey fabric under relaxed condition. According to this wet processing, the temporal extension of the weft yarn due to the weaving operation was eliminated in the relaxed condition, so that the potential torque of the textured yarn was created. According to the creation of this potential torque of the weft yarn, distinctive crepes characerized by sharp edges, deep valleys and steep projected portions were developed in the fabric. Consequently, the grey fabric was shrunk very much. Next, the above-mentioned crepe fabric was subjected to a conventional tentering operation so that the crepes of the fabric were heat-set under a predetermined heat-set temperature. The condition of crepe development of this fabric was very unique as shown by the photograph in FIG. 13A. Next this crepe fabric was subjected to dyeing and finishing.

Figure 13B:
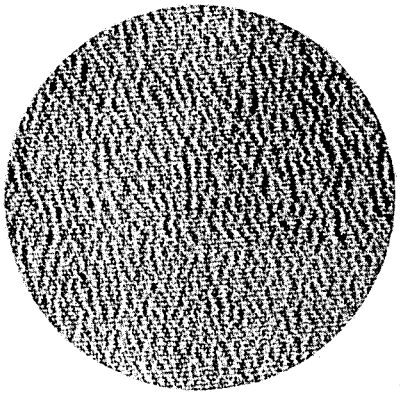
FIG. 13B is a photograph showing crepes of a comparative crepe fabric utilizing a conventional textured yarn.
Figure 7C:
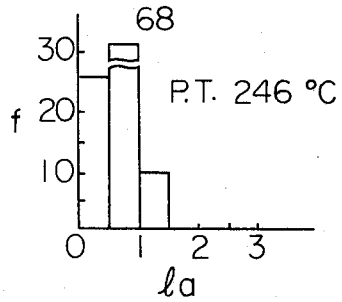
Figure 7D:
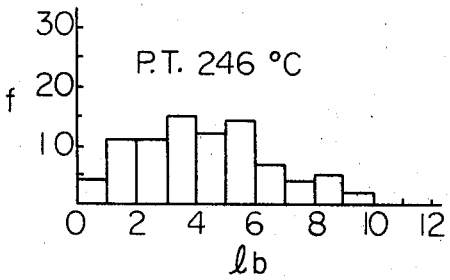
Figure 7E:
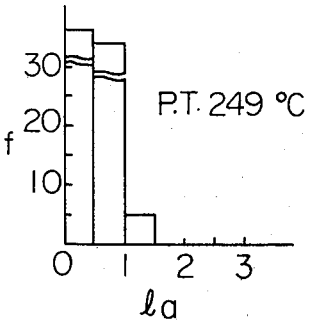
Figure 7F:
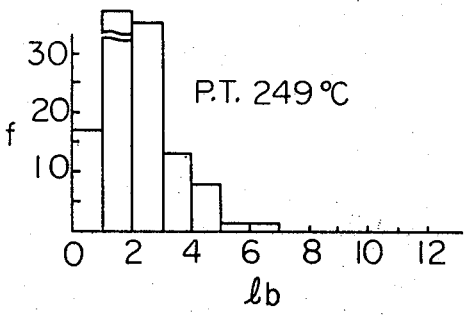

A crepe fabric was produced which has distinctive crepes which were set in stable condition. For clearer understanding the characteristic feature of the crepe fabric according to the present invention, a photograph of a crepe fabric utilizing the above-mentioned conventional textured yarn is shown in FIG. 13B. As the configuration of the textured yarn used as the weft yarn has a particular configuration as already explained, the feeling of the finished crepe fabric has a preferable crispness.

EXAMPLE 2

A polyethyleneterephthalate multifilament yarn of 75 d/24 f was subjected to a false-twist operation by the same machine as Example 1 under a processing temperature of 245°C, which temperature was different from that used in Example 1.

As the processing temperature was higher than that in Example 1, certain practical troubles were expected because of the creation of snarls during the processing. Consequently, the following two different modified methods were applied to produce crepe fabric similar to that of Example 1.

a. The potential torque of the textured yarn was temporarily set by applying a sizing operation to the textured yarn after the yarn was rewound on a package. A desizing operation was simultaneously carried out during the wet processing applied in the processing described in Example 1. The same sizing agent and desizing agent as used in Example 3 were utilized. As the coefficient of false-twist was stronger than Example 1, the potential torque of the textured yarn was stronger than Example 1, and consequently, a crepe fabric having more distinctive development of crepes and a crisp and desired touch was produced.
b. To reduce the potential torque so as to prevent snarl creation during the operation, an additional twist (number of additional twist was 500 T/meter, identical twist direction to the false-twist operation) was imparted to the above-mentioned textured yarn. The same weaving and finishing operation as in Example 1 were applied, and a crepe fabric having a quality similar to Example 1 was produced.

EXAMPLE 3

A polyamide multifilament (Nylon 6) yarn of 120 d/30 f was subjected to a false-twist operation by the same false-twist machine as Example 1 under the following conditions.

| | | |
|---|---|---|
| (a) | Spindle r.p.m. | $20 \times 10^4$ |
| (b) | Number of the false-twist | 3200 T/meter S direction or Z direction |
| (c) | Processing temperature | 210°C |
| (d) | Percentage of over-feed in a yarn supply | 1% |

-continued

| | | |
|---|---|---|
| (e) | Percentage of over-feed to yarn winding | 5% |

To prevent a trouble due to snarl during the weaving operation, the potential torque of the textured yarn was temporarily set by sizing, and the desizing operation was applied to a grey fabric as follows. That is, the textured yarn produced by the above-mentioned false-twist operation was treated by a roller sizing operation with a size mainly consisting of a copolymer of PVA with acrylic ester in such a condition that the crimps of the textured yarn were straightened. Then the following grey fabric having a structure of "crepe weave" was produced.

a. Warp yarn:

A two textured yarn having S direction of false-twist and another two textured yarn having Z direction of false-twist were alternatively arranged.

Density of reed 93/3.8 cm 2 warp yarn/reed b. Weft yarn:

The same arrangements of S and Z false-twist yarns as the warp yarn.

Density: 120 picks/3.8 cm c. Width of Grey Fabric: 115 cm

Next, the grey fabric was subjected to a desizing operation by utilizing a conventional washer. The desizing operation was carried out in a desizing liquid including nonionic surfactant and weakly alkaline scouring agent containing soda ash for 45 minutes, under a processing temperature between 95°and 100°C.

During this processing, mechanical vibration was applied to the fabric so that distinctive crepes were developed in the fabric. After completion of this desizing wet processing, the fabric was subjected to a conventional tentering operation to set the crepe of the fabric, and then the scoured and heat-set fabric was dyed and finished. it was confirmed that a crepe fabric has been produced which had novel crepe characterized by distinctive cubical and stable crepe and a fairly nice crisp feel. This fabric was understood to be perfect for utilization as a fabric material for spring, and summer clothes for ladies.

EXAMPLE 4

A polyamide multifilament (Nylon 6) yarn of 120 d/30 f was subjected to a false-twist operation by the same false-twist machine as Example 1 and under the same conditions as Example 3. A positive additional twist (500 T/meter) was imparted to the textured yarns (S or Z false-twist) so as to apply the twist operation in the opposite directions to the rotational direction of the false-twist spindle, respectively.

The same sizing weaving, desizing operations and finishing operation as those of Example 3 were applied. According to these operations, a unique crepe fabric having more fine crepes than that of Example 3 was produced. Moreover, the crepe fabric of this example had a distinctive feel of crispness.

What is claimed is:

1. A synthetic multifilament textured yarn provided with a particular configuration comprising a plurality of compact portions and a plurality of bulky portions formed between two adjacent compact portions, said compact portions being randomly positioned along the longitudinal axis of the yarn and consisting of a plurality of individual filaments collected in compact condition with a twist, each of said bulky portions consisting of a plurality of crimped individual filaments positioned indepently from each other and each bulky portion having an opposite twisted direction of multifilament yarn from the twisted direction of said two adjacent compact portions.

2. A synthetic multifilament textured yarn according to claim 1, further provided with an additional twist being in an identical direction to the twist in the compact portion.

3. A synthetic multifilament textured yarn according to claim 1, wherein said yarn is a polyester multifilament yarn.

4. A method for producing a synthetic multifilament textured yarn from a material multifilament yarn comprising a plurality of individual filaments, by means of a false-twisting apparatus having a false-twisting head comprising 1. supplying said material multifilament yarn to a false-twisting apparatus in an over-feeding condition,
2. passing the material yarn through a heating zone at a temperature within a range between the softening temperature and melting temperature of the yarn while maintaining said over-feeding condition, the individual filaments of the yarn being softened and partially melted such that the filaments are intermittently fused together to form random compact portions,
3. passing said material yarn in a heated condition through the false-twisting head, whereby random bulky portions are formed on the yarn after the yarn passes through the false-twisting head, and
4. taking up the resulting treated yarn delivered from the false-twisting head on a take-up device, whereby a textured yarn is provided having a plurality of randomly distributed compact portions distributed along the longitudinal axis of the yarn and a plurality of bulky portions, each of said bulky portions consisting of a plurality of crimped individual filaments positioned independently from each other and each bulky portion having an opposite twisted direction of multifilament yarn from the twisted direction of the two adjacent compact portions.

* * * * *